US006636188B1

(12) United States Patent
Kanazawa et al.

(10) Patent No.: US 6,636,188 B1
(45) Date of Patent: Oct. 21, 2003

(54) METHOD OF DRIVING PLASMA DISPLAY PANEL AND PLASMA DISPLAY APPARATUS

(75) Inventors: Yoshikazu Kanazawa, Kawasaki (JP); Tomokatsu Kishi, Kawasaki (JP); Shigeharu Asao, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 37 days.

(21) Appl. No.: 09/702,875

(22) Filed: Nov. 1, 2000

(30) Foreign Application Priority Data

Mar. 28, 2000 (JP) ..... 2000-089480

(51) Int. Cl.[7] ..... G09G 3/28; H01J 17/49

(52) U.S. Cl. ..... 345/60; 345/68; 313/584

(58) Field of Search ..... 345/60, 68, 63, 345/67, 148, 55, 69, 211, 213; 178/7.3; 315/169.4; 313/584

(56) References Cited

U.S. PATENT DOCUMENTS

| | | | | |
|---|---|---|---|---|
| 5,436,634 A | | 7/1995 | Kanazawa | 345/67 |
| 6,104,362 A | * | 8/2000 | Kuriyama et al. | 345/213 |
| 6,107,978 A | * | 8/2000 | Nagaoka et al. | 315/169.4 |
| 6,222,512 B1 | | 4/2001 | Tajima et al. | 345/63 |
| 6,249,265 B1 | | 6/2001 | Tajima et al. | 345/63 |
| 6,335,712 B1 | * | 1/2002 | Kim | 315/169.4 |
| 6,356,249 B1 | * | 3/2002 | Lim | 345/63 |

FOREIGN PATENT DOCUMENTS

| | | | |
|---|---|---|---|
| EP | 0 762 373 | | 3/1997 |
| JP | 09-311662 | * | 2/1997 |
| JP | 9-311662 | | 12/1997 |
| JP | 2801893 | * | 9/1998 |
| JP | 2000-39867 | | 2/2000 |
| JP | 2001-013909 | * | 1/2001 |

* cited by examiner

*Primary Examiner*—Amare Mengistu
*Assistant Examiner*—Prabodh Dharia
(74) *Attorney, Agent, or Firm*—Staas & Halsey LLP

(57) ABSTRACT

A method of driving a plasma display panel in which a normal operation is not impeded and an erroneous discharge, that may damage the panel, will never occur even when flicker is suppressed in a PDP employing an ALIS system. Some subfields that make up a display field of a frame, that is, a subfield of a first group, are represented by first display lines and the rest, that is, a subfield of a second group, are represented by second display lines; thus, a total display field is obtained and a gray scale is represented.

20 Claims, 15 Drawing Sheets

ODD FIELD

EVEN FIELD

SUBFIELD OF THE FIRST HALF

SUBFIELD OF THE SECOND HALF

METHOD OF DRIVING PLASMA DISPLAY PANEL AND PLASMA DISPLAY APPARATUS

BACKGROUND OF THE INVENTION

The present invention relates to a method of driving a plasma display panel and a plasma display apparatus employing the method. More particularly, the present invention relates to a method of driving a plasma display panel of an Alternate Lighting of Surfaces (referred to as ALIS hereinafter) type, in which plural first and second electrodes are arranged adjacently and each of plural display lines is formed between a respective pair of adjacent electrodes, and a plasma display apparatus employing the same.

A plasma display panel (PDP) has good visibility because it generates its own light, is thin and can be made with a large and high-speed display; therefore, it is attracting interest as a replacement for a CRT display. A general PDP has n (equal to 512, here) Y electrodes 11 and X electrodes 12 arranged adjacently by turns, making up n pairs of Y electrode 11 and X electrode 12, and emits light for display between Y electrode 11 and X electrode 12 of each pair. The Y electrodes and X electrodes are called display electrodes (also called sustaining electrodes), and address electrodes are actually provided in the direction that runs at a right angle to the aforementioned electrodes, though they are omitted here. As a result, 2n display electrodes (Y electrodes and X electrodes) are required to make up n display lines.

On the other.hand, a method of emitting light, in which light emission is caused to occur between every two adjacent display electrodes, has been disclosed in Japanese Patent No.2801893 corres. to EP 0 762 373 A2, as shown in FIG. 1B. This is called the ALIS system. As the detailed structure of the ALIS system has been disclosed in Japanese Patent No. 2801893, only points relating to the present invention will be briefly described here. As shown in FIG. 1B, a PDP employing the ALIS system has n (equal to 512, here) Y electrodes (first electrodes) 15-O and 15-E, and n+1 X electrodes (second electrodes) 16-O and 16-E, arranged adjacently by turns, and light emission is caused to occur for display between every pair of adjacent display electrodes (Y electrodes and X electrodes). As a result, 2n+1 display electrodes make up 2n display lines. This means that the ALIS system can double the precision with the same number of display electrodes as that of the structure shown in FIG. 1A. The ALIS system is also characterized by a high luminance because the discharge space can be used efficiently without any waste and a high opening ratio can be obtained due to a small loss of light due to electrodes or the like.

FIG. 2 illustrates the display method employing the ALIS system. Every pair of two adjacent display electrodes is used to cause discharge for display, but it is impossible to cause discharge between all display lines at the same time. Therefore, so-called interlaced scanning, in which odd-numbered lines and even-numbered lines are used in a time-shared manner for display, is performed. As shown in FIG. 2, odd-numbered display lines are used for display in the odd field and even-numbered display lines are used for display in the even field, and the display combining the odd field and the even field can be obtained as a total field.

FIG. 3 shows the principle of operation during the sustaining discharge period in the ALIS system, FIG.3A shows the operation in the odd field, and FIG.3B shows that in the even field. In the odd field, a voltage Vs is applied to electrodes Y1 and X2, X1 and Y2 are connected to the ground level, and discharge is caused to occur between X1 and Y1, and X2 and Y2, that is, in the odd-numbered display lines. At this time, the voltage difference between Y1 and X2 of the even-numbered display line is equal to zero, and no discharge is caused to occur. Similarly in the even field, a voltage Vs is applied to electrodes X1 and Y1, Y2 and X2 are grounded, and discharge is caused to occur between. Y1 and X2, and Y2 and X1, that is, in the even-numbered display lines.

FIG. 4 shows a drive circuit of a PDP employing the ALIS system. X electrodes and Y electrodes are arranged in parallel, alternately, and address electrodes 19 are arranged in the direction that runs at a right angle to the aforementioned electrodes. Reference number 15-O refers to an odd-numbered Y electrode, 15-E to an even-numbered Y electrode, 16-O to an odd-numbered. X electrode, and 16-E to an even-numbered X electrode. Y electrodes are connected to a scan driver 23. The scan driver 23 is equipped with switches 24, being designed to switch so that scan pulses are applied sequentially during the address period, and the odd-numbered Y electrode 15-O is connected to a first Y sustaining pulse generation circuit 25, and the even-numbered Y electrode 15-E is connected to a second Y sustaining pulse generation circuit 26 during the sustaining discharge period. Similarly, the switches 24 are switched so that the odd-numbered X electrode 16-O is connected to a first X sustain pulse generation circuit 21 and the even-numbered X electrode 16-E is connected to a second X sustain pulse generation circuit 22. The address electrode 19 is connected to an address driver 27.

FIGS. 5 and 6 show drive waveforms of a PDP employing the ALIS system. FIG. 5 shows drive waveforms in the odd field and FIG. 6 shows those in the even field. As shown in FIG. 5, a voltage pulse is applied between every pair of adjacent X electrode and Y electrode to perform the initialization discharge in every display line during the reset period. The address period is divided into the first half and the second half. In the odd field, scan pulses are applied to an odd-numbered Y electrode (Y1) sequentially during the first half of the address period. At this time, a positive voltage is applied to the odd-numbered X electrodes (X1, X3), the even-numbered X electrode (X2) is grounded, and a small negative voltage is applied to the even-numbered Y electrode (Y2), therefore, address discharge is caused to occur only in the address lines to which an address pulse is applied between the odd-numbered X electrode and the odd-numbered Y electrode, and as a result, wall-charge accumulates. During the second half of the address period in the odd field, scan pulses are applied to the .even-numbered Y electrode (Y2) sequentially, a positive voltage is applied to the even-numbered X electrode (X2), the odd-numbered X electrodes (X1, X3) are grounded, and a small negative voltage is applied to the odd-numbered Y electrode (Y1), therefore, address discharge is caused to occur only between the even-numbered X electrodes and the even-numbered Y electrodes. As a result, charges corresponding to the display data accumulates in the odd-numbered display lines. Moreover, during the sustaining discharge period, sustaining pulses with opposite phases are applied between the odd-numbered X electrode and the odd-numbered Y electrode, and between the even-numbered X electrode and the even-numbered Y electrode, and sustaining discharge, which is light emission for display, is caused to occur in the odd-numbered display lines. The luminance of the field is determined by the times sustaining discharge is caused to occur (number of sustaining pulses).

As shown in FIG. 6, during the first half of the address period in the even field, address discharge is caused to occur between the odd-numbered Y electrode and the even-numbered X electrode, and during the second half, address discharge is caused to occur between the even-numbered Y electrode and the odd-numbered X electrode, sustaining pulses with opposite phase are applied between the odd-numbered Y electrode and the even-numbered X electrode, and between the even-numbered electrode and the odd-numbered X electrode, and as a result, light emission for display is caused to occur in the even display lines.

In a PDP, a display field is divided into plural subfields and representation of a gray scale is realized by combining lit subfields according to the gray level to display. Drive waveforms shown in FIG. 5 or FIG. 6 are applied to each subfield and the above-mentioned operation is performed. As mentioned above, the luminance of each subfield is determined by the number of the sustaining pulses, and as many gray levels as possible are represented by as small a number as possible of the subfields by changing the luminance of each subfield. It is well known that the gray scale is represented most efficiently when the ratio of the luminance of each field is set at 1:2:4:8 . . . , that is, each figure is a number of 2 to nth power. Because of the problem of color false contour, however, in some cases plural subfields with the same luminance are provided as disclosed in Japanese Unexamined Patent Publication (Kokai) No.9-311662.

FIG. 7 is a schematic showing a drive sequence when the subfield method is adopted in the ALIS system.

As shown schematically, a display field is divided into an odd field and an even field. When 30 fields are displayed in a second, the display period of a field is 33.3 ms, that is, 16.7 ms for each odd field and even field. The odd field and the even field are divided into n subfields (SF), respectively, and the operation shown in FIG. 5 is carried out in each SF in the odd field, and that shown in FIG. 6, in each SF in the even field. The length of the sustaining discharge period for each SF, that is, the number of times sustaining discharge is performed, is determined according to the luminance.

The ALIS system is similar to the interlaced display system, and in an example shown in FIG. 7, each line is displayed in either the odd field or even field, that is, each line is displayed at a frequency of 30 Hz, resulting in a problem of flicker. The frequency of 30 Hz does not cause the problem of flicker for normal video displays, but does for displays of characters or the like in some cases. Therefore, when a.PDP employing the interlaced display system is used to display characters, a one-sided field system is employed, in which only either odd-numbered display lines or even-numbered display lines are used repeatedly as shown in FIG. 8. In this system, a display field is not divided into an odd field and an even field. In the one-sided field system, the number of lines to be displayed is halved, but each display line is displayed at 60 Hz, therefore, this system is used in a case where flicker is a problem rather than a high resolution. When only either odd-numbered display lines or even-numbered display lines are used, only the used display lines are deteriorated, therefore, the display lines are switched once a day or when the power is turned on to lengthen the life, as disclosed in Japanese Patent Application No. 10-135398.

When a PDP employing the ALIS system is operated in a one-sided field system as shown in FIG. 8, a large discharge beyond a pair of X electrode and Y electrode is caused to occur and the normal operation cannot be expected or a problem that the insulation layer in the panel or the drive circuit is broken will occur.

As shown in FIG. 9A, the cause of this problem may be that negative charge accumulates on one side of the panel and positive charge on the other side as operation proceeds, and when the amount of the accumulated charge exceeds a certain level, a discharge is caused to occur beyond the electrodes as shown in FIG. 9B. Though the cause is not cleared sufficiently yet, the following may explain the cause. As shown in FIG. 10, a discharge between X electrode and Y electrode is caused to occur by a discharge between address electrode and Y electrode as a trigger during the address period. The electrons and ions generated during the discharge are moved by charges in the discharge space and electrons are sent to the positive electrode, or X electrode, and ions to the negative electrode, or Y electrode, and they accumulate on the surface of each electrode. A sustaining discharge after the address discharge is caused to occur when voltages of opposite polarity are applied to X electrode and Y electrode alternately, but it is impossible to cancel all the charges accumulated during the address period completely to restore the original status because the sustaining pulse has a voltage of 150 to 180 V, which is lower than the voltage of 200 V between X electrode and Y electrode during the address period. In a PDP employing the ALIS system, the distances between the odd-numbered Y electrode and the even-numbered X electrode, and between the odd-numbered X electrode and the even-numbered Y electrode are smaller than those of a general PDP, therefore, it may be possible for the electrons or ions accumulated between a pair of electrodes to move to an adjacent pair of electrodes during discharge. Therefore, when a display operation is repeated, electrons and ions (or electrons only) may be considered to move to both sides (or one side only) of the panel and accumulate thereon.

In either case, the above-mentioned problems have occurred when a PDP employing the ALIS system is operated with the one-sided field system. These problems have not occurred during the interlaced scan performed in a PDP employing the ALIS system.

SUMMARY OF THE INVENTION

The present invention has been developed to solve these problems and the purposes of the present invention are to provide a method of driving a plasma display panel that does not cause an erroneous discharge to occur, which may impede a normal operation or damage the panel while flicker in the display is suppressed in a PDP employing the ALIS system, and a plasma display apparatus employing same.

FIG. 11 is a schematic showing the structure of the principle of the present invention.

As shown schematically, in the method of driving the plasma display panel and the plasma display apparatus employing same according to the present invention, some of the subfields (one or more subfields of a first group) that make up the display field of a frame are represented by the first display lines and the rest (one or more subfields of a second group) are displayed by the second display lines, and both groups make up a total display field and a display with gray scale is provided. In other words, it is impossible to get a normal display with gray scale, only with the subfields of the first group represented by the first display lines, and it is also impossible to get a normal display with gray scale, only with the subfields of the second group represented by the second display lines.

According to the present invention, a display field is not divided into an odd field and an even field, and is displayed at a frequency twice that when divided, therefore, flicker may not occur. Moreover, according to the result of the experiment, a large discharge beyond the above-mentioned pair of electrodes did not occur. This may be because a display is formed by the first and the second display lines in a short time and partial charges do not accumulate.

There can be several ways to divide the subfields displayed by the first lines and those displayed by the second lines. For example, plural subfields can be divided into a first half and a second half, and the subfields of the first half are displayed by one of the first and the second display lines, and those of the second half are displayed by the other of the first and second display lines.

FIGS. 12A and 12B are schematics showing how discharge is performed in this case. As shown in FIG. 12A, discharge is performed in odd-numbered display lines in the subfield of the first half, and charges move within each pair of electrodes to accumulate partially, but this will be canceled because discharge is performed in even-numbered display lines in the subfield of the second half, and charges move in the opposite direction as shown in FIG. 12B.

It is also possible to display by the first and the second display lines alternately in order of the subfields. Furthermore, a gray level of which the luminance is medium or higher is represented by both the first and the second display lines.

Still furthermore, as disclosed in Japanese Unexamined Patent Publication (Kokai) No. 9-311662, when plural subfields with the same luminance are provided, some of the subfields with the same luminance are displayed by the first display lines, and the rest thereof are displayed by the second display lines.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

The embodiments of the present invention are described below. The PDP in this embodiment explained here is a PDP employing the ALIS system structure, as disclosed in Japanese Patent No. 2801893, and the same drive circuit can be used, though a difference exists in the display sequence. Therefore, an explanation of the ALIS system structure and the drive circuit is omitted here, instead, only the display sequence is described here.

Figure 13:
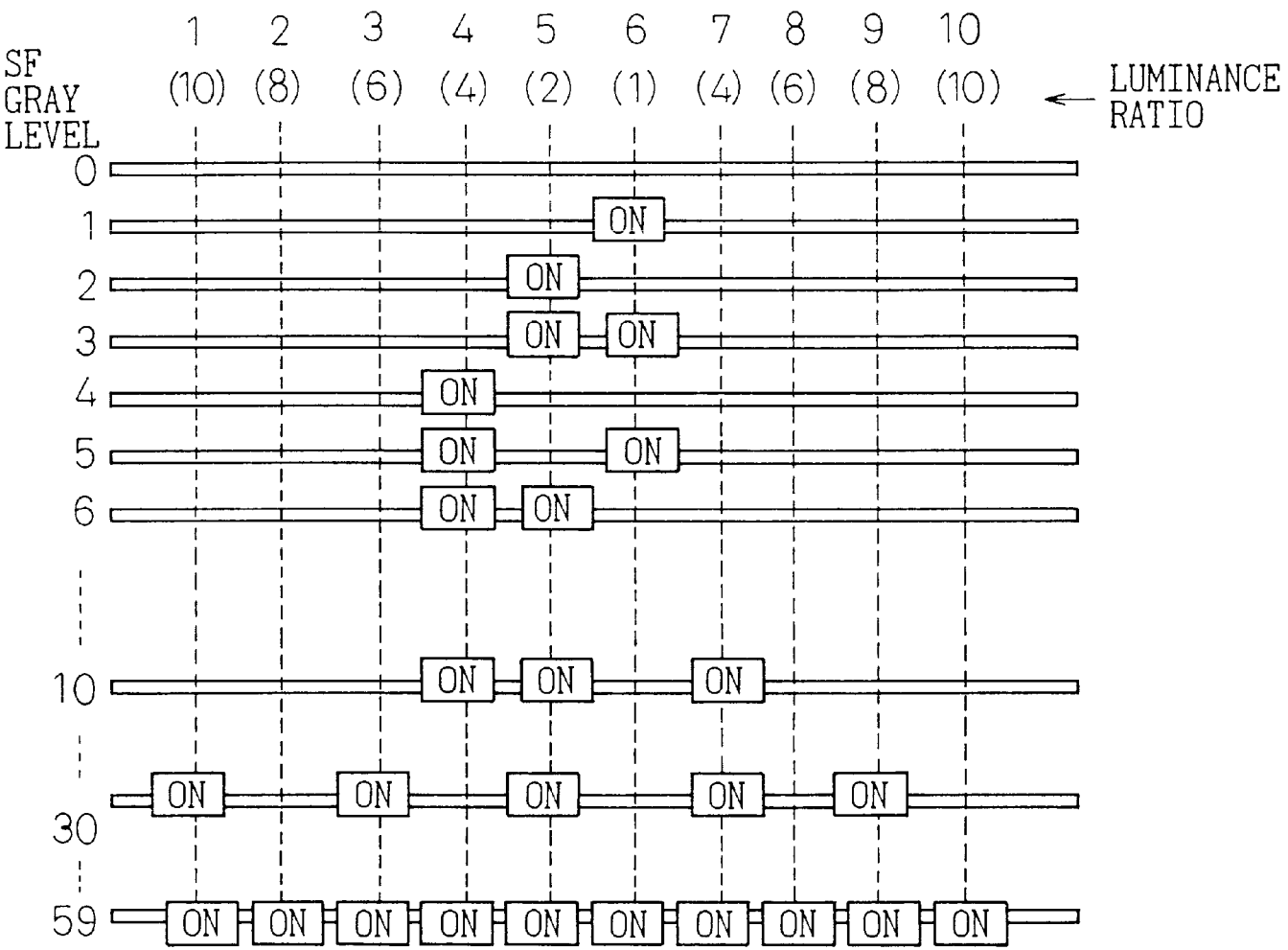
FIG. 13 is a schematic showing the structure of the subfields in the embodiments of the present invention.

FIG. 13 is a schematic showing the structure of the subfields of the PDP apparatus in the first and the second embodiments of the present invention. The structure of the subfields is designed to suppress the occurrence of the color false contour, as shown in Japanese Unexamined Patent Publication (Kokai) No. 9-311662, and the luminance ratio of SF1 to SF10 is set at 10:8:6:4:2:1:4:6:8:10. By combining these subfields, gray levels from 0th through 59th can be represented, and the combinations for gray level, 10 are shown schematically for example. In addition, since there are two subfields for several terms of the luminance ratio among plural terms of the luminance ratio, there can be plural combinations of the subfields for the same gray level, and the combination may be changed.

Figure 14:
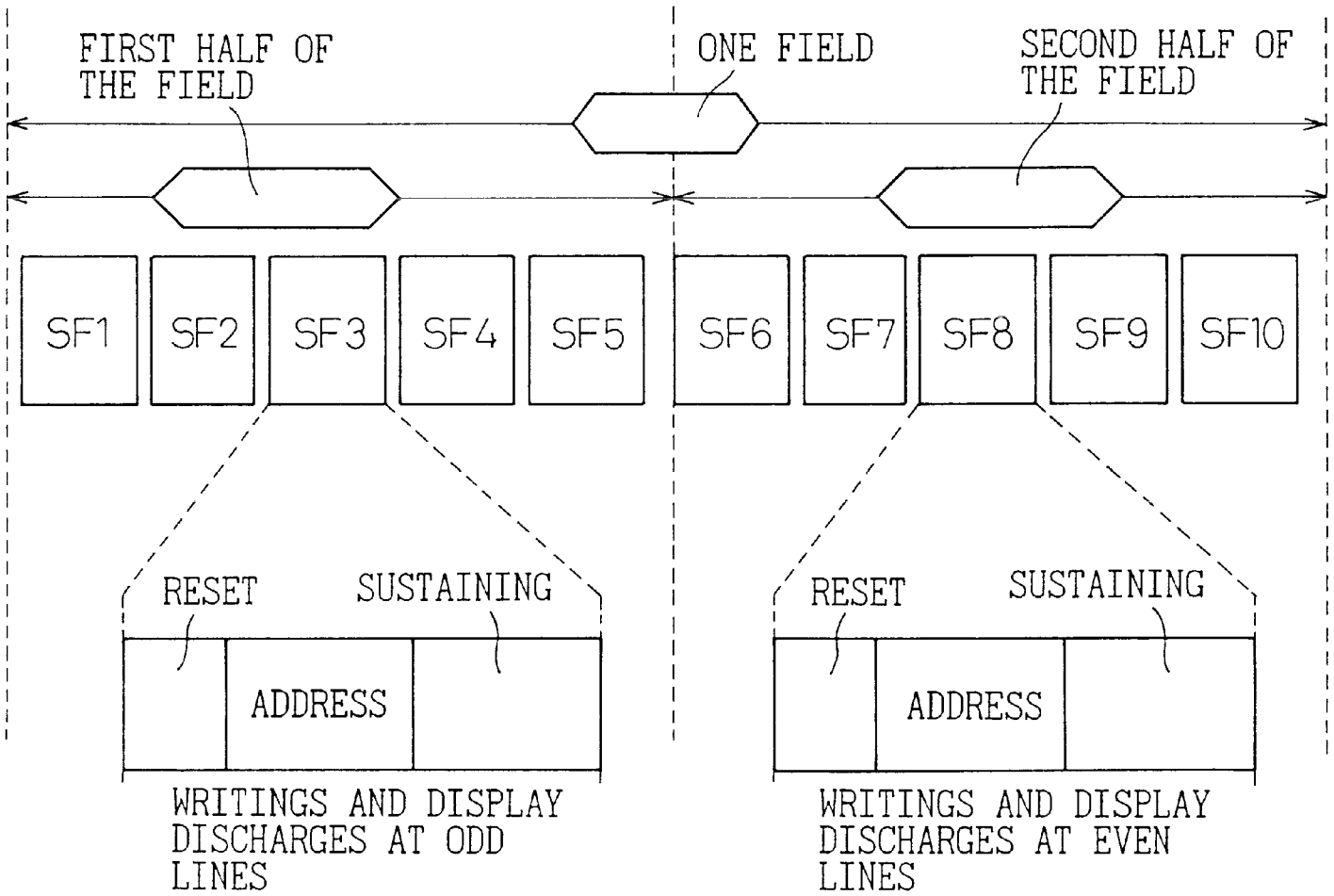
FIG. 14 is a schematic showing the display sequence in the first embodiment of the present invention.

FIG. 14 is a schematic showing the display sequence of the PDP apparatus in the first embodiment of the present invention. As shown schematically, in the first half of the field of a field display, SF1 through SF5 in the subfield structure shown in FIG. 13 are displayed, and in the second half of the field, SF6.through SF10 are displayed. In the subfield structure shown in FIG. 13, subfields of high terms of the luminance ratio are arranged symmetrically, and when a low gray level is displayed, subfields near the center are selected, but when a high gray level is displayed, both the first half and the second half of the field are selected. As a result, both the first half and the second half of the field emit light with the exception of cases where extremely low gray levels are displayed. This means that both the first and second display lines emit light. Therefore, there will be no partial accumulation of charges.

Figure 15:
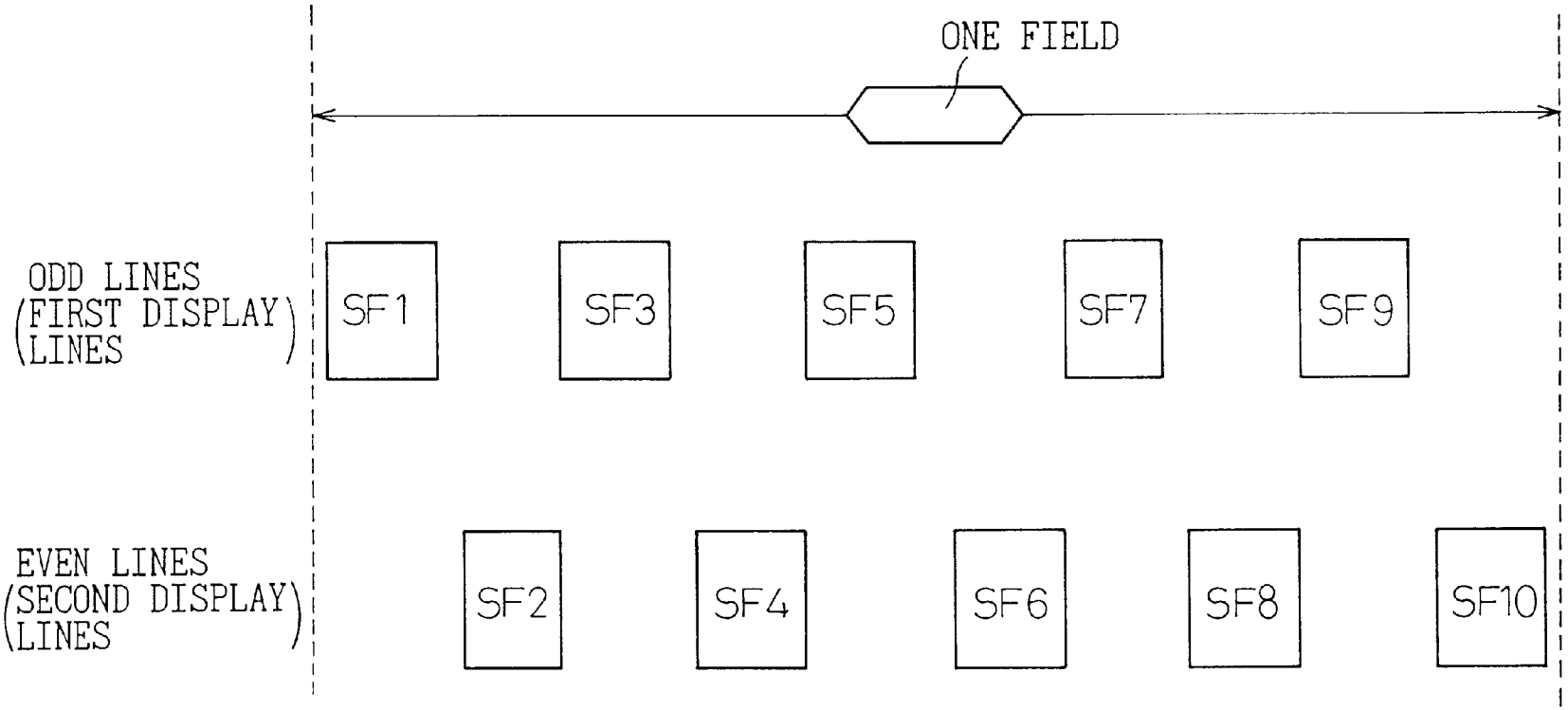
FIG. 15 is a schematic showing the display sequence in the second embodiment of the present invention.

FIG. 15 is a schematic showing the display sequence of the PDP apparatus in the second embodiment of the present invention. As shown schematically, the odd-numbered subfields SF1, SF3, SF5, SF7, and SF9 are displayed by the first display lines and the even-numbered subfields SF2, SF4, SF6, SF8, and SF10 are displayed by the second display lines. In this case, pairs of the subfields with the same terms of the luminance ratio, that is, SF1 and SF10, SF9 and SF2, SF3 and SF8, and SF4 and SF4 are displayed by the first display lines and the second display lines, respectively. As a result, there will be no partial accumulation of charges.

Figure 1A:
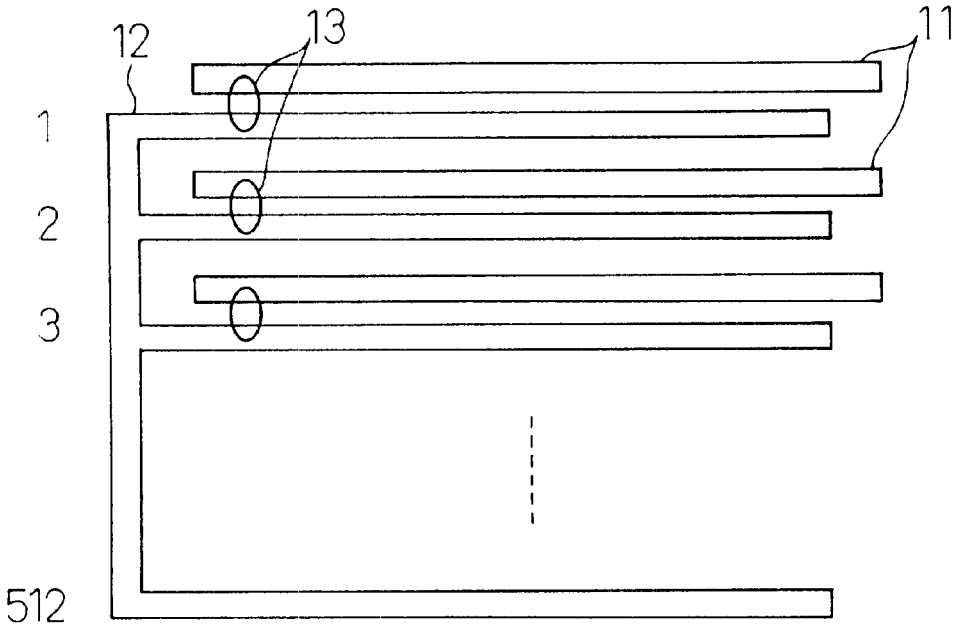
FIGS. 1A and 1B are schematics illustrating a PDP employing the ALIS system, which makes use of discharge between every pair of adjacent electrodes.
Figure 1B:
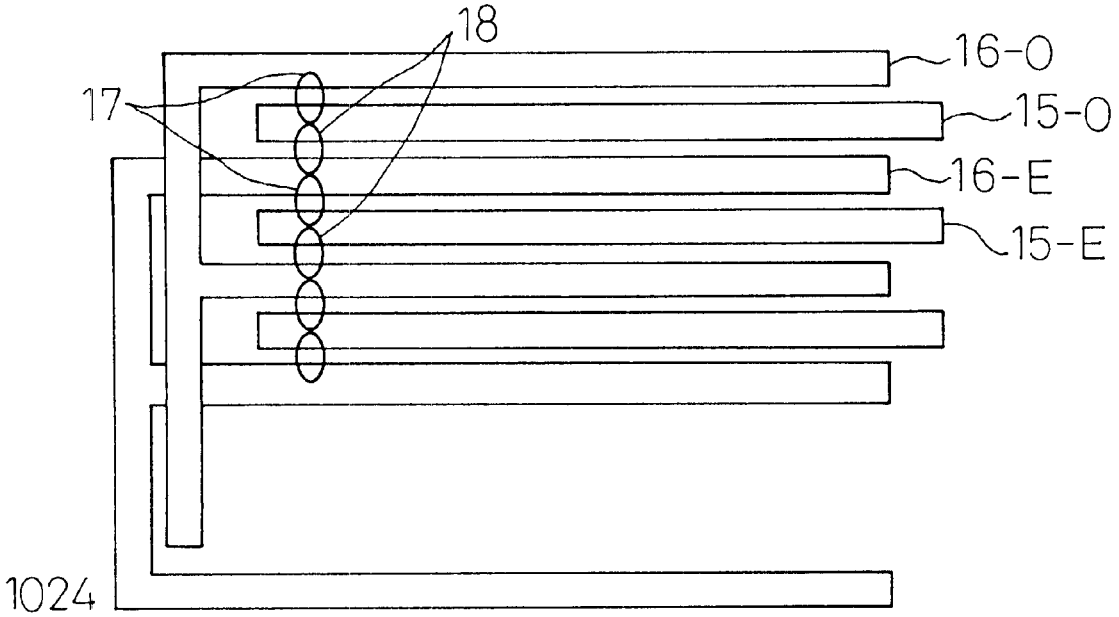
Figure 2:
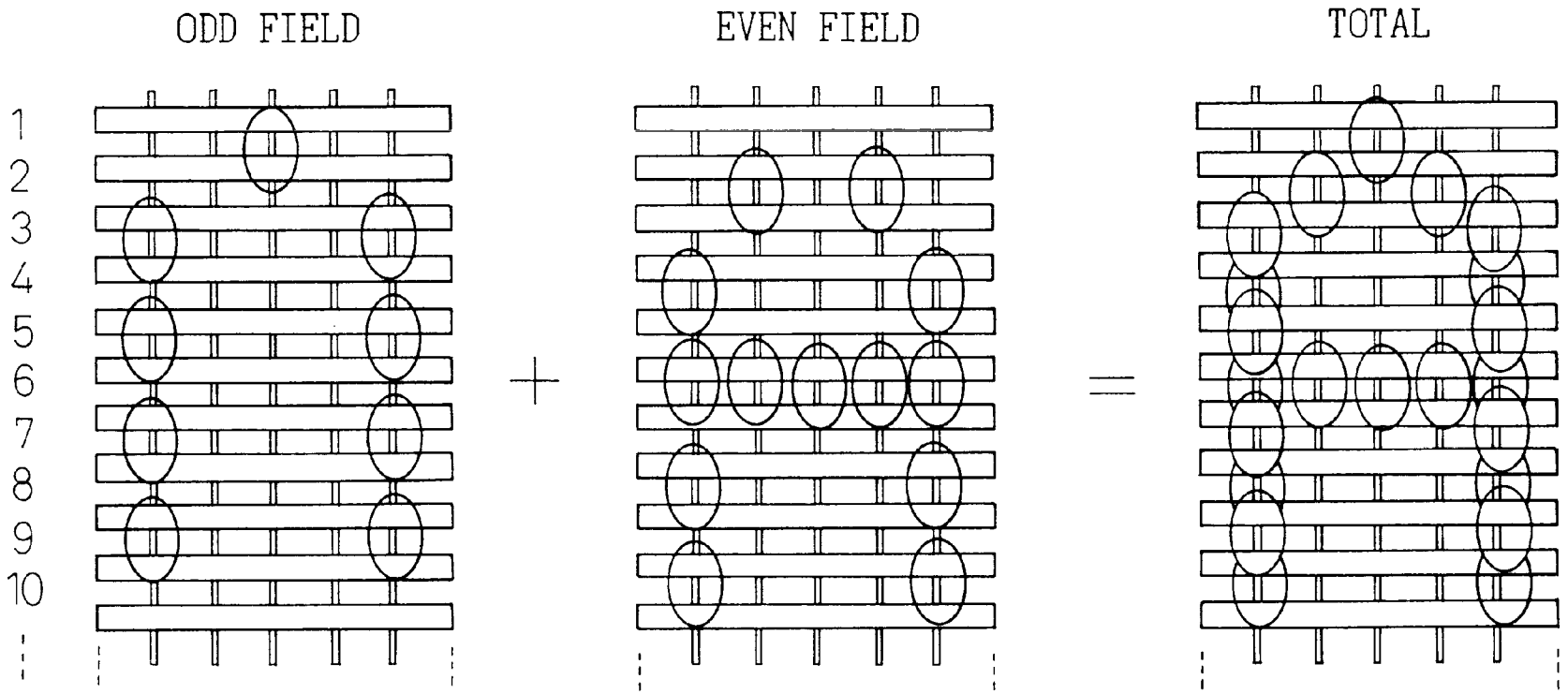
FIG. 2 is a schematic showing display in the ALIS system.
Figure 3A:
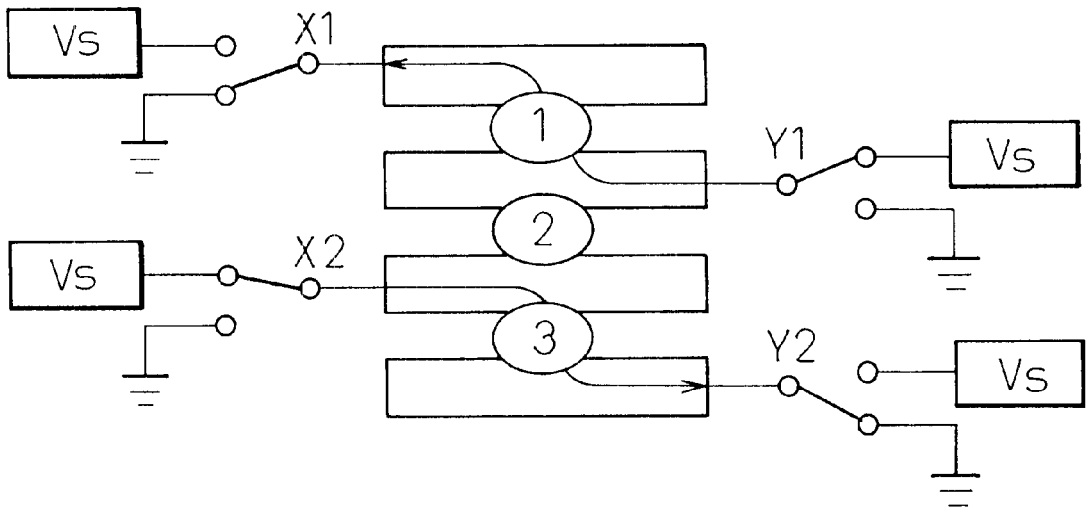
FIGS. 3A and 3B are schematics showing the principle of operation of the ALIS system.
Figure 3B:
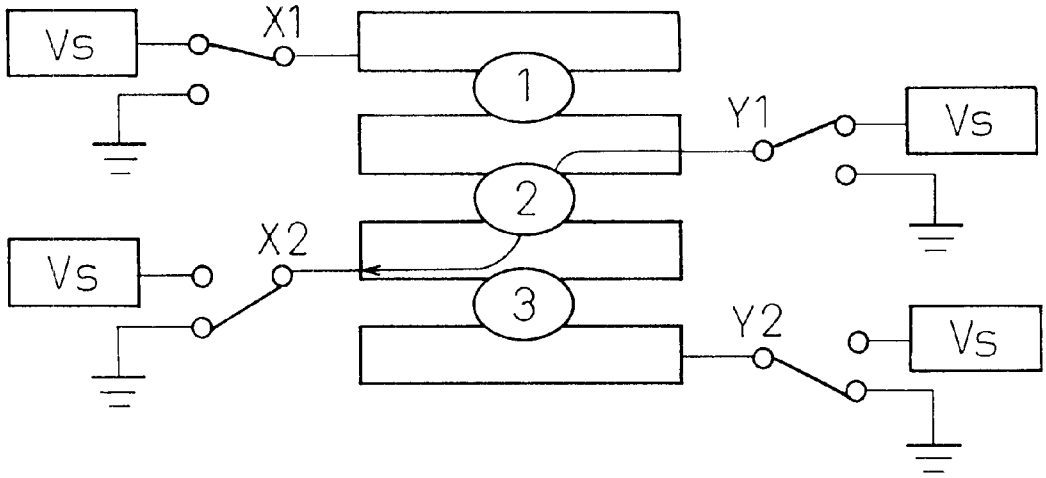
Figure 4:
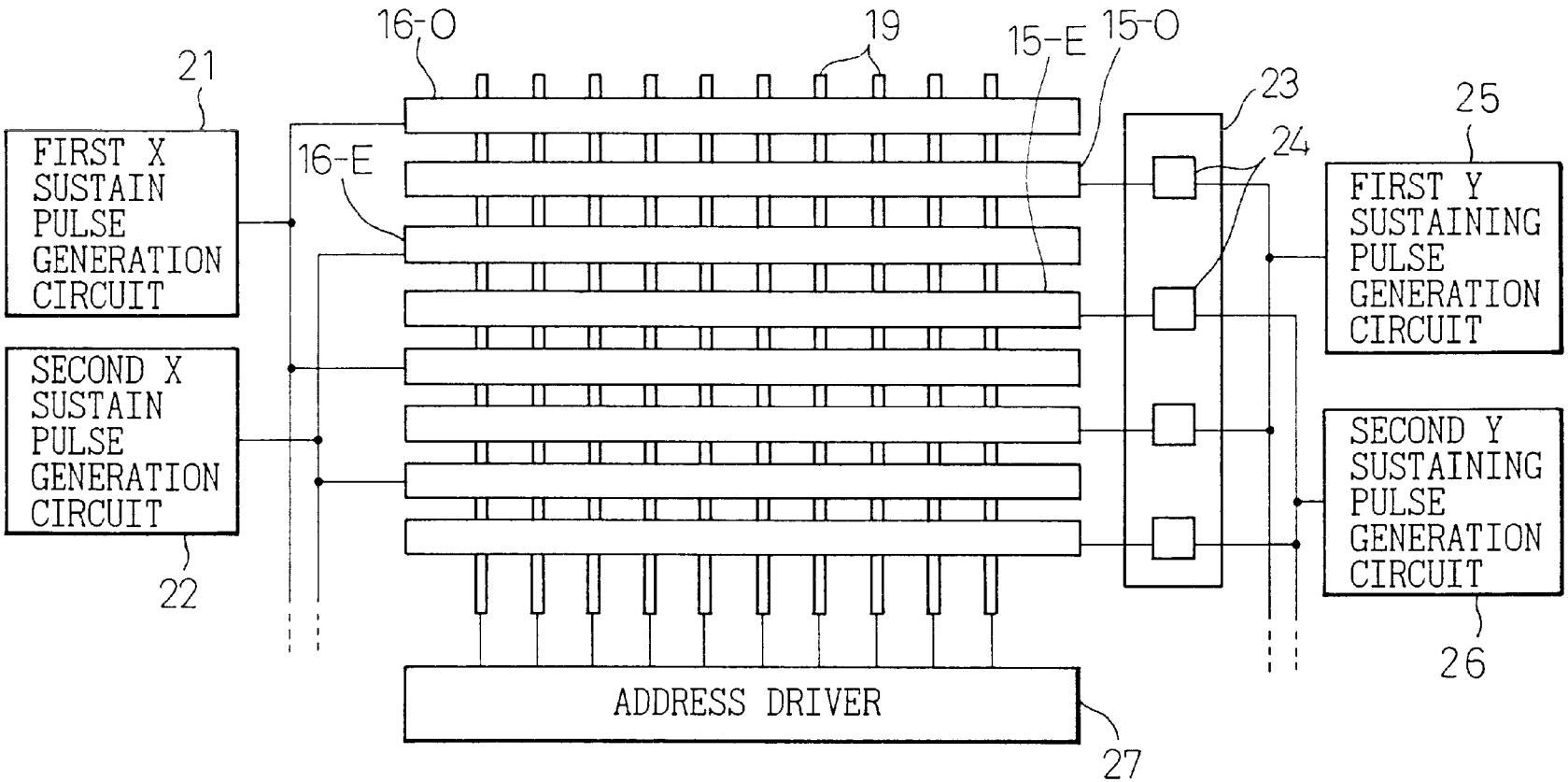
FIG. 4 is a schematic showing a drive circuit of a PDP employing the ALIS system.
Figure 5:
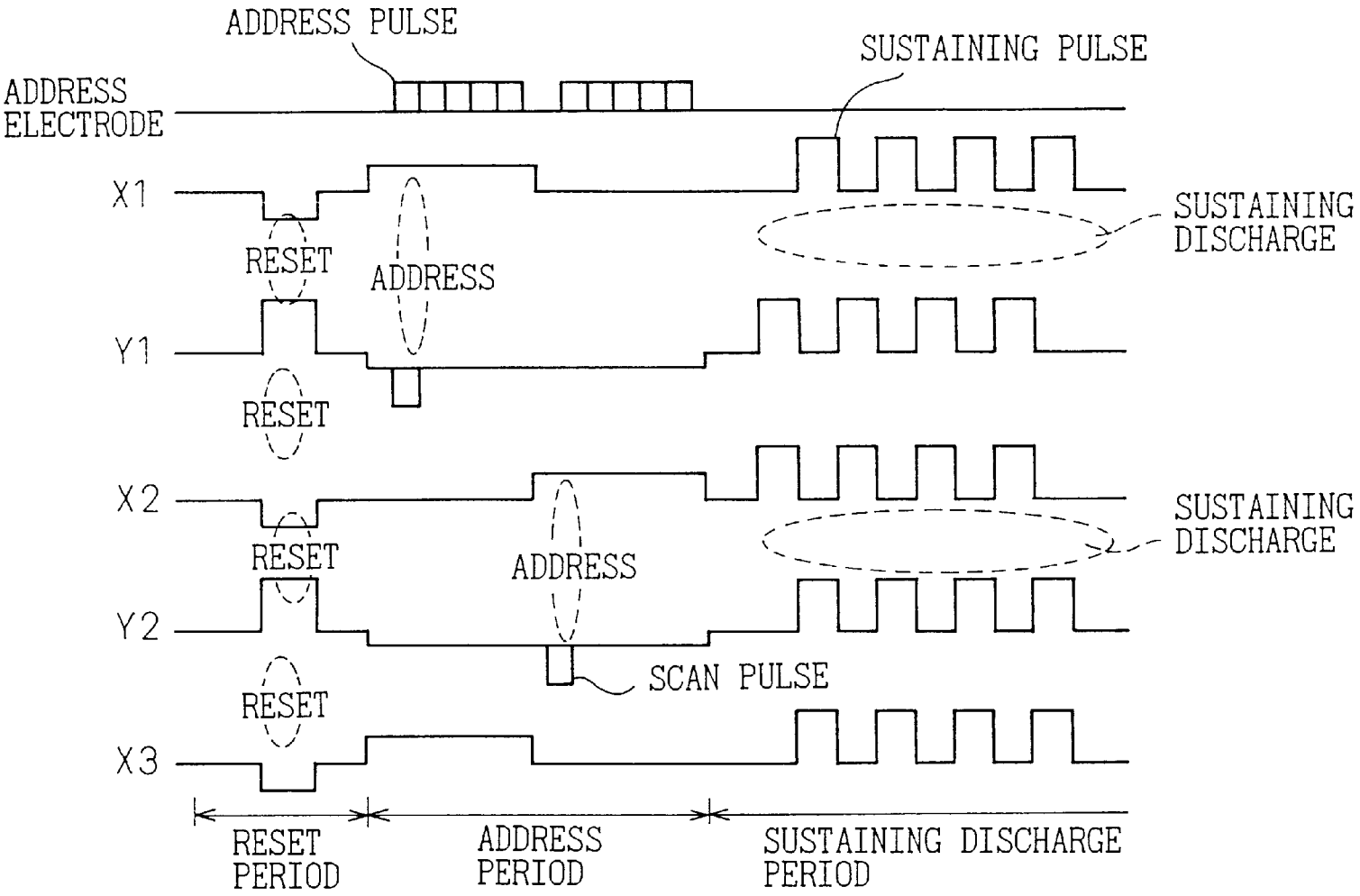
FIG. 5 is a schematic showing drive waveforms (odd field) of the ALIS system.
Figure 6:
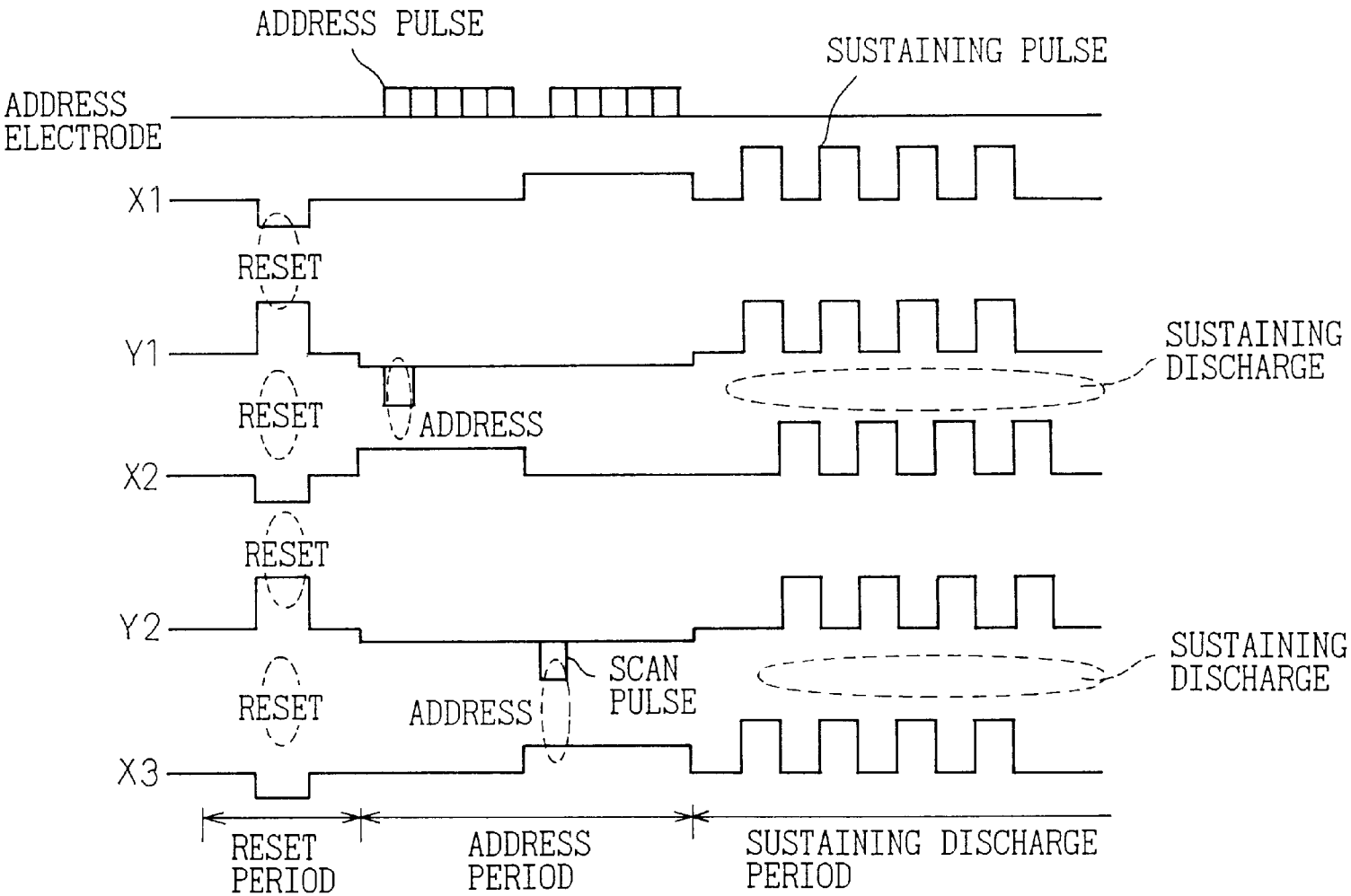
FIG. 6 is a schematic showing drive waveforms (even field) of the ALIS system.
Figure 7:
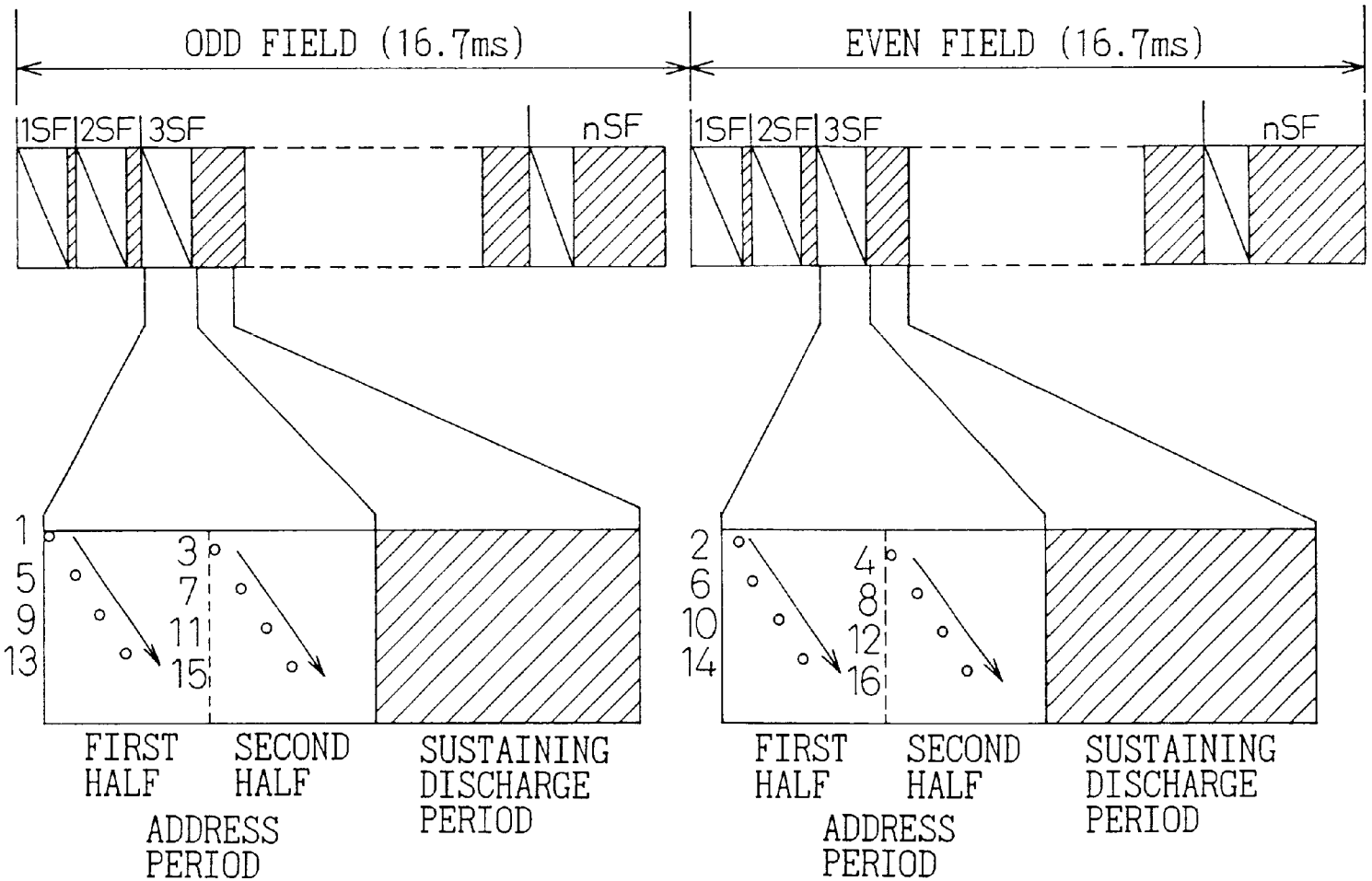
FIG. 7 is a schematic showing a drive sequence when the subfield method is employed in the ALIS system.
Figure 8:
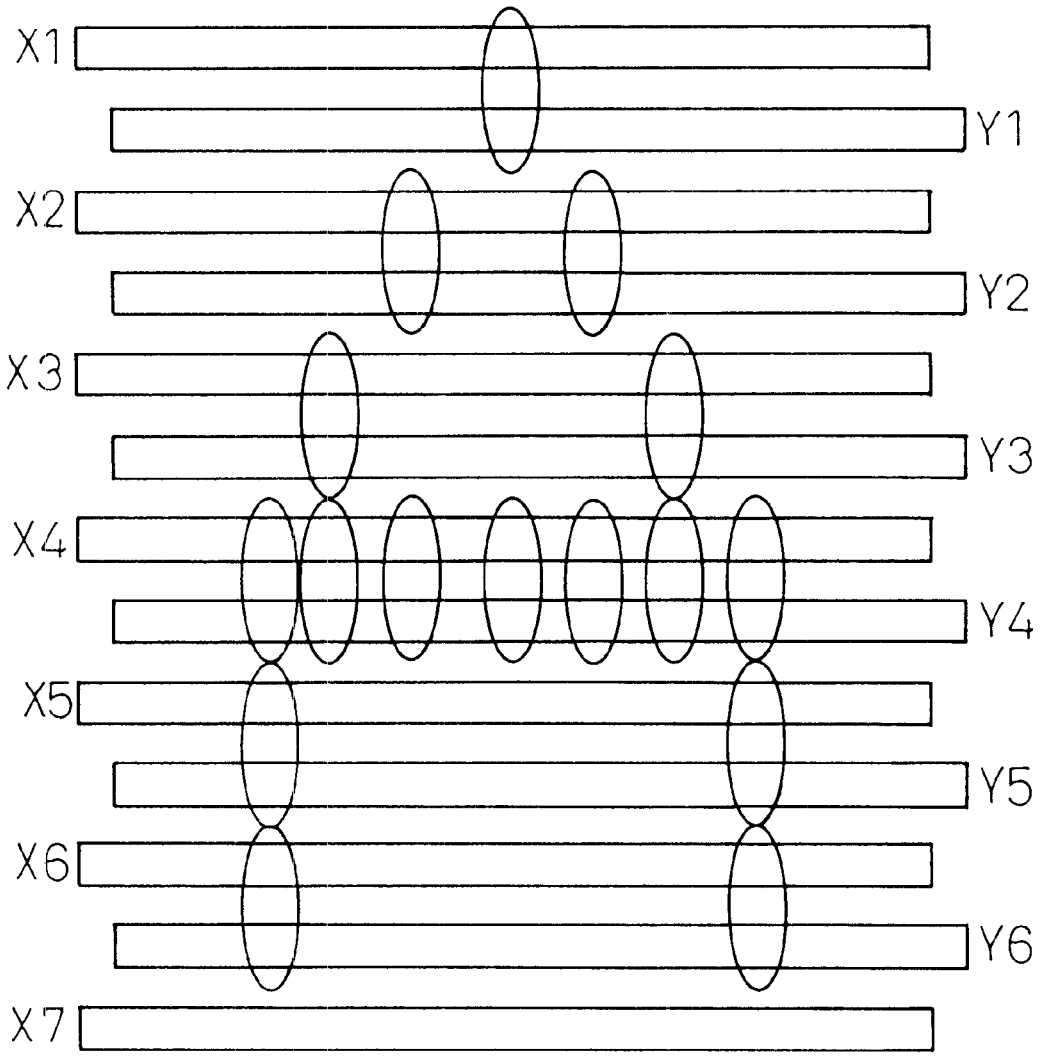
FIG. 8 is a schematic showing the display using only one of the display lines (one-sided field method)
Figure 9A:
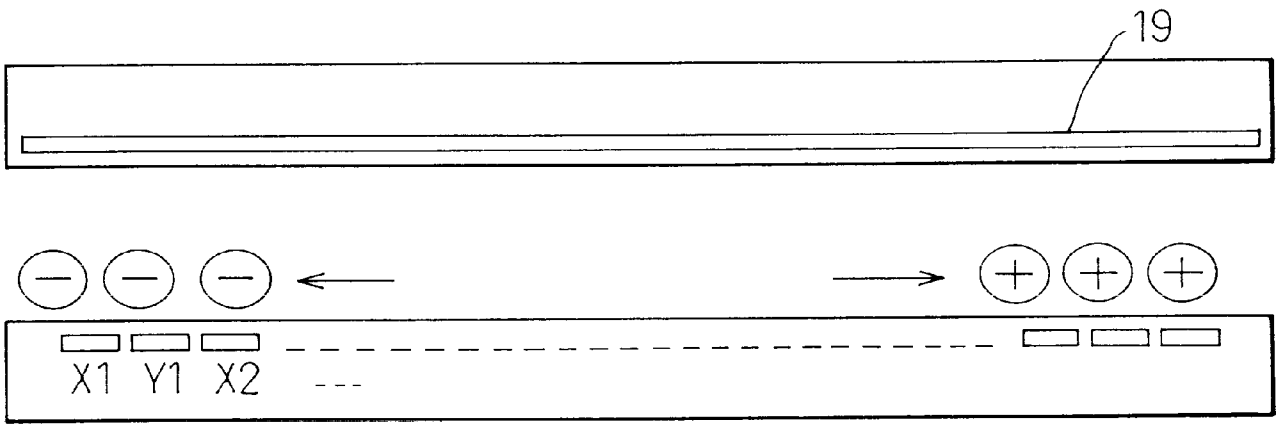
FIGS. 9A and 9B are schematics explaining a problem relating to the one-sided field method.
Figure 9B:
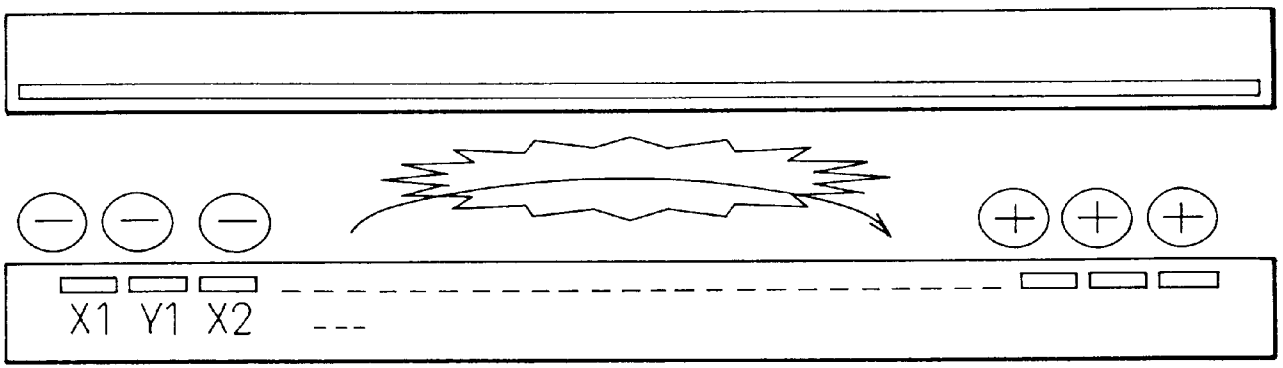
Figure 10:
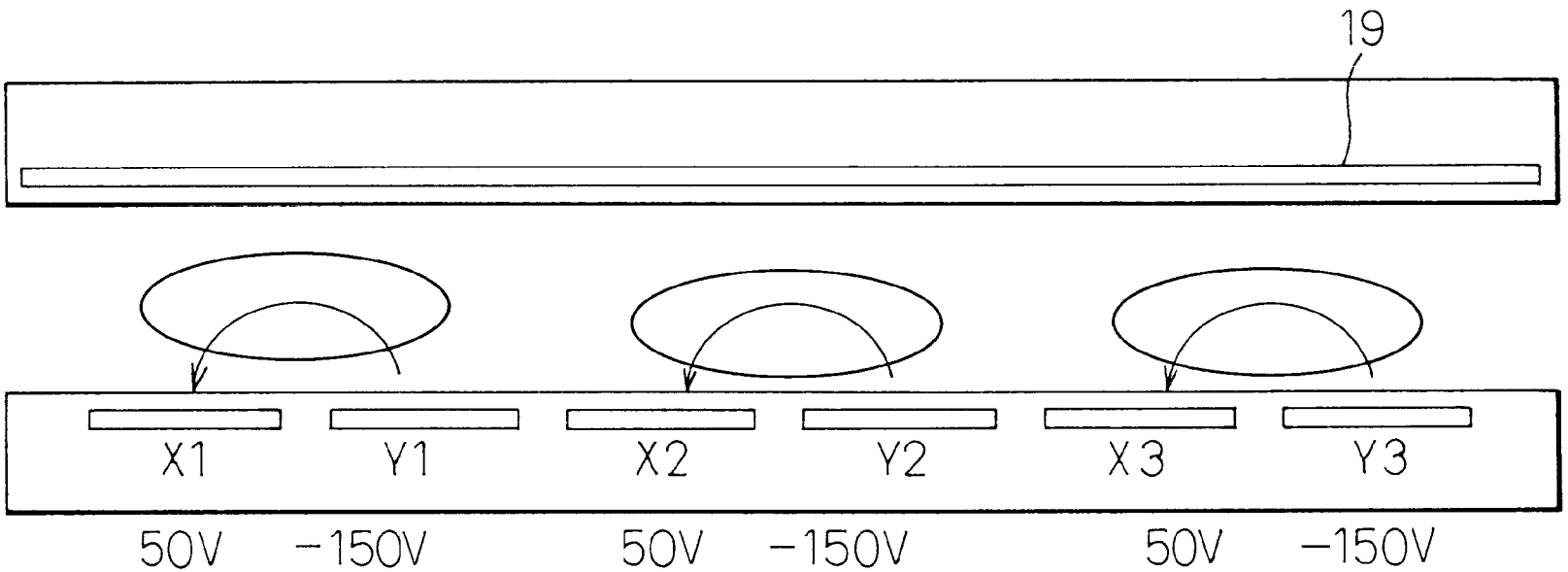
FIG. 10 is a schematic explaining a possible cause of the problem relating to the one-sided field method.
Figure 11:
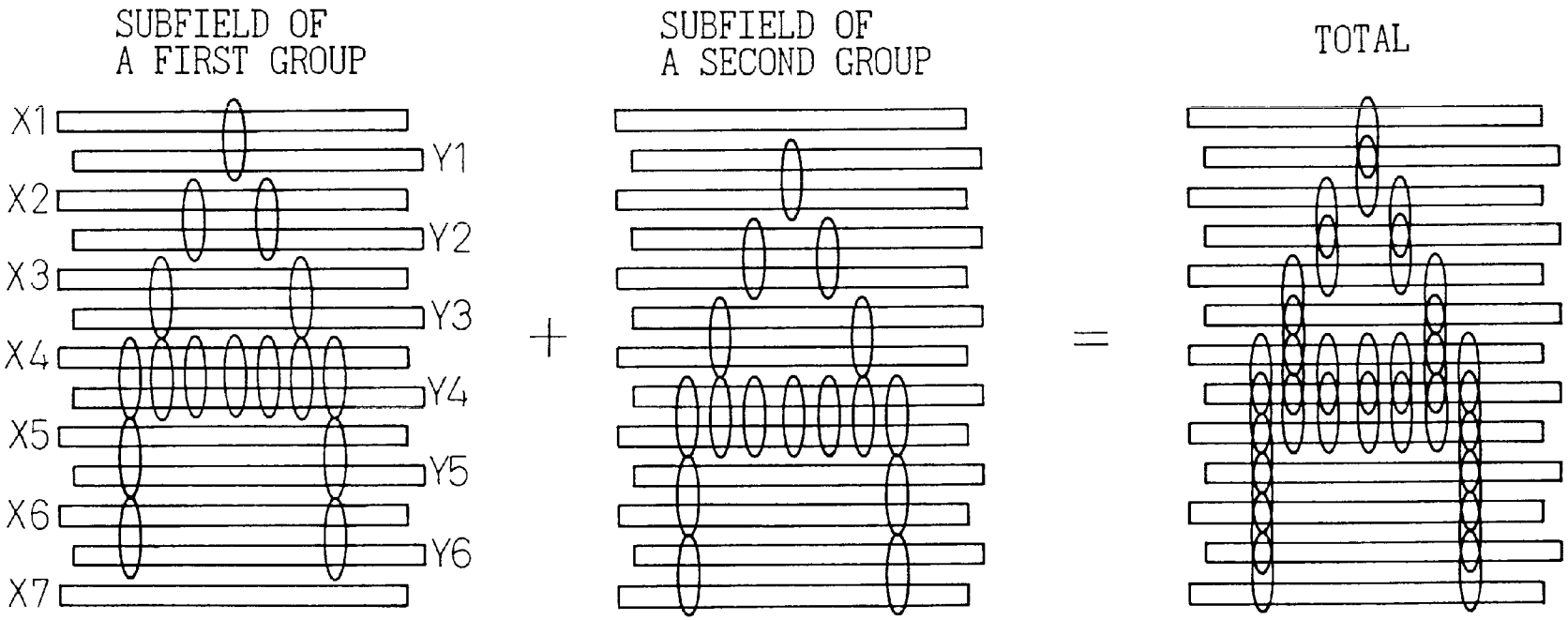
FIG. 11 is a schematic showing the structure of the principle of the present invention.
Figure 12A:
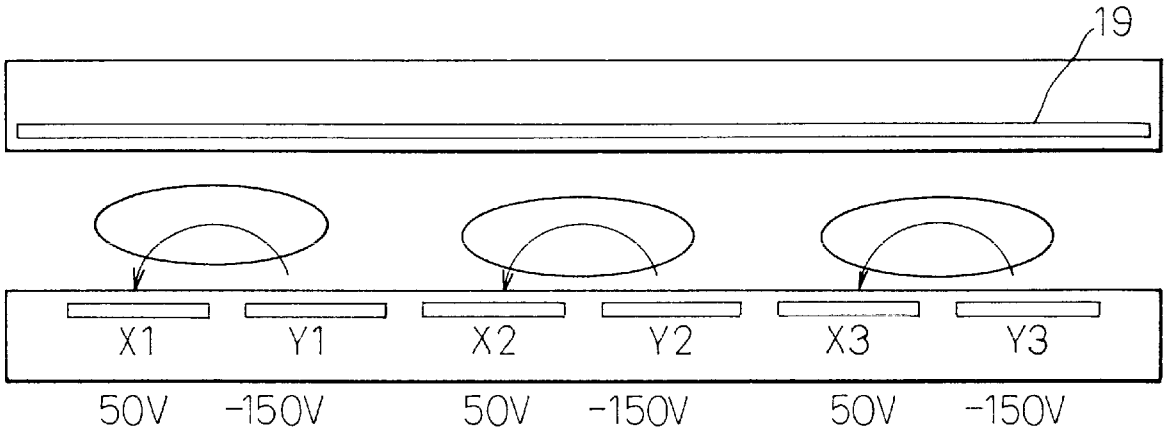
FIGS. 12A and 12B are schematics showing the operation of discharge of the present invention.
Figure 12B:
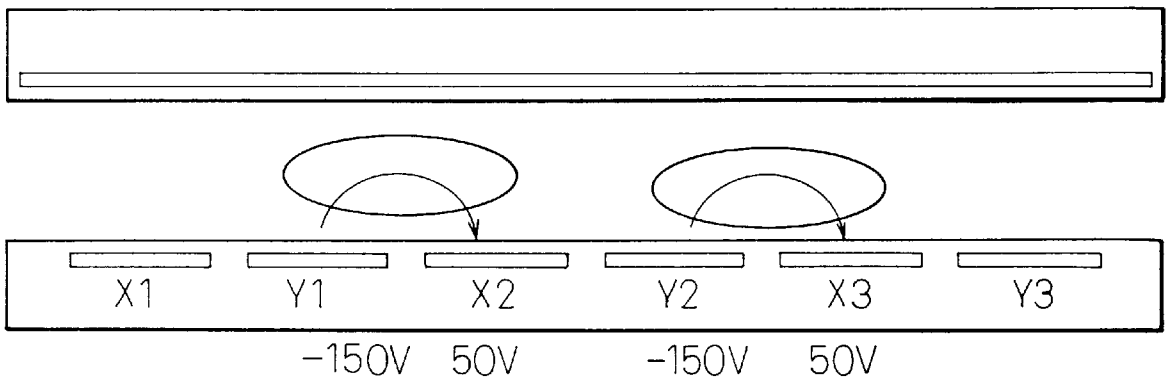

In addition, according to the present invention, since both the first and second display lines emit light, the display is smoother compared to the one-sided field method shown in FIG. 8.

Furthermore, since both the first and second display lines emit light, a longer lifetime can be expected compared to the case where only one of the display lines is used.

As explained above, according to the present invention, the normal operation will not be impeded and an erroneous discharge, which may damage the panel, will never occur even when flicker is suppressed in a PDP employing the ALIS system.

Sill furthermore, the displayed image is smoother and a longer lifetime of the panel can be expected compared to the one-sided field method that has no flicker.

What is claimed is:

1. A one-sided field method of driving a plasma display panel having plural first and second electrodes arranged adjacently by turns, wherein:

a first display line is formed between one side of the first electrode and one of the second electrodes adjacent to the one side, and a second display line is formed between the other side of the said first electrode and another one of the second electrodes adjacent to the other side;

a display field of a frame comprises a set of subfields to be used for display with gray scale and, a desired gray scale is represented by combining subfields, each of which is selected for display from the set of subfields;

the set of subfields comprises one or more subfields represented by the first display lines and another one or more subfields represented by the second display lines; and each subfield is represented by a combination of only the first display lines or a combination of only the second display lines.

2. A method of driving a plasma display panel as set forth in claim 1, wherein:

the set of subfields is divided into subfields of a first half and subfields of a second half; and the subfields of the first half are represented by one of the said first and the second display lines and the subfields of the second half are represented by the other one of the said first and the second display lines.

3. A method of driving a plasma display panel as set forth in claim 1, wherein:

the first and second display lines are used for display, alternately and in the order of the subfields.

4. A method of driving a plasma display panel as set forth in claim 1, wherein:

a representation of gray scale with a luminance of middle or higher levels is produced by subfields displayed respectively by the first and the second display lines.

5. A method of driving a plasma display panel as set forth in claim 1, wherein:

the set of subfields includes at least two subfields with the same weighted luminance; and at least one of the two subfields is represented by the said first display lines and the other one of the two subfields is represented by the second display lines.

6. A method of driving a plasma display panel as set forth in claim 1, comprising:

dividing the set of subfields into subfields of a first half and subfields of a second half; and representing the subfields of the first half by one of the first and second display lines and the subfields of the second half by the other one of the first and second display lines.

7. A method of driving a plasma display panel as set forth in claim 1, further comprising:

defining, in the set of subfields, at least two subfields having the same weighted luminance; and representing at least one of the two subfields by the first display lines and the other of the two subfields by the second display lines.

8. A plasma display apparatus having plural first and second electrodes arranged adjacently by turns, comprising:

a first display line formed between one side of the first electrode and one of the second electrodes adjacent to the one side, and a second display line formed between the other side of the said first electrode and another one of said second electrodes adjacent to the other side;

a display field of a frame comprises a set of subfields to be used for display with gray scale, a desired gray scale being represented by combining subfields, each of which is selected for display from the set of subfields when a one-sided field driving method is performed;

the set of subfields comprises one or more subfields represented by the first display lines and another one or more subfields represented by the second display lines; and each subfield is represented by a combination of only the first display lines or a combination of only the second display lines.

9. A plasma display apparatus as set forth in claim 8, wherein:

the set of subfields is divided into subfields of a first half and subfields of a second half; and the subfields of the first half are represented by one of the said first and the second display lines and the subfields of the second half are represented by the other one of the said first and the second display lines.

10. A plasma display apparatus as set forth in claim 8, wherein:

the first and second display lines are used for display, alternately and in the order of the subfields.

11. A plasma display apparatus as set forth in claim 8, wherein:

a representation of gray scale with a luminance of middle or higher levels is produced by subfields displayed respectively by the first and the second display lines.

12. A plasma display apparatus as set forth in claim 8, wherein:

the set of subfields includes at least two subfields with the same weighted luminance; and at least one of the two subfields is represented by the said first display lines and the other one of the two subfields is represented by the second display lines.

13. A one-sided field method of driving a plasma display panel having plural first and second electrodes arranged In an alternating, adjacent and parallel relationship, comprising plural first and second display lines formed on respective, first and second opposite sides of each first electrode and respectively between the first electrode and the respective, alternate second electrodes adjacent the first and second opposite sides of the first electrode, the method comprising:

defining a display field of a frame to comprise a set of subfields to be used for a gray scale display and producing a desired gray scale display by selectively combining subfields selected for display from the set of subfields;

defining each set of subfields to comprise one or more subfields represented by the first display lines and another one or more subfields represented by the second display lines; and representing each subfield by using a combination of only the first display lines or a combination of only the second display lines.

14. A method of driving a plasma display panel as set forth in claim 13, further comprising:

using the first and the second display lines, alternately, and in the order of the subfields.

15. A method of driving a plasma display panel as set forth in claim 13, further comprising:

producing a representation of gray scale with a luminance of middle or higher levels, relatively to a range of luminance, from a lower and through the middle and to the higher levels, by displaying subfields respectively by the first and the second display lines.

16. A plasma display apparatus having plural first and second electrodes arranged in an alternating, adjacent and parallel relationship and driven by a one-sided driving method, comprising:

plural first and second display lines formed on respective, first and second opposite sides of each first electrode and respectively between the first electrode and the respective, alternate second electrodes adjacent the first and second opposite sides of the first electrode;

a unit defining a display field of a frame to comprise one set of subfields to be used for a gray scale display and producing a desired gray scale display by selectively combining subfields selected for display from the set of subfields;

a unit defining each set of subfields to comprise one or more subfields represented by the first display lines and another one or more subfields represented by the second display lines; and a unit representing each subfield by using a combination of only the first display lines or a combination of only the second display lines.

17. A plasma display apparatus as set forth in claim 16, wherein:

the set of subfields is divided into subfields of a first half and subfields of a second half; and the subfields of the first half are represented by one of the said first and the second display lines and the subfields of the second half are represented by the other one of the said first and the second display lines.

18. A plasma display apparatus as set forth in claim 16, wherein:

the first and second display lines are used for display, alternately and in the order of the subfields.

19. A plasma display apparatus as set forth in claim 16, wherein:

a representation of gray scale with a luminance of middle or higher levels is produced by subfields displayed respectively by the first and the second display lines.

20. A plasma display apparatus as set forth in claim 16, wherein:

the set of subfields includes at least two subfields with the same weighted luminance; and at least one of the two subfields is represented by the said first display lines and the other one of the two subfields is represented by the second display lines.

* * * * *